US008109304B2

(12) United States Patent
Alves

(10) Patent No.: US 8,109,304 B2
(45) Date of Patent: Feb. 7, 2012

(54) MOBILE HAND-HELD CUTTING DEVICE GUIDE AND SUPPORT APPARATUS

(76) Inventor: Paul Alves, North Dartmouth, MA (US)

( * ) Notice: Subject to any disclaimer, the term of this patent is extended or adjusted under 35 U.S.C. 154(b) by 257 days.

(21) Appl. No.: 12/021,349

(22) Filed: Jan. 29, 2008

(65) Prior Publication Data

US 2009/0188585 A1 Jul. 30, 2009

(51) Int. Cl.
*B27C 5/00* (2006.01)

(52) U.S. Cl. ..... 144/144.1; 409/210; 409/214

(58) Field of Classification Search ..... 144/136.95, 144/144.1, 145.1; 409/206, 207, 210, 214
See application file for complete search history.

(56) References Cited

U.S. PATENT DOCUMENTS 2,888,965 A * 6/1959 Phillips ..... 144/1.1
4,044,805 A * 8/1977 Gronholz ..... 144/154.5
4,290,719 A * 9/1981 Worthington et al. ..... 409/180
4,434,824 A * 3/1984 Bussey ..... 144/144.1
RE33,045 E 9/1989 Gronholz et al.
4,878,644 A * 11/1989 Downing ..... 248/674
5,062,460 A * 11/1991 DeLine ..... 144/136.95
5,082,234 A * 1/1992 Smith ..... 248/669
5,092,234 A * 3/1992 Von Rohr ..... 100/351
6,792,984 B2 * 9/2004 Fontaine ..... 144/135.2
6,880,595 B2 * 4/2005 Nuss ..... 144/135.2
7,089,978 B2 * 8/2006 Karkosch et al. ..... 144/136.95
7,108,463 B2 * 9/2006 Hummel ..... 409/182
7,281,887 B2 * 10/2007 Taylor ..... 409/182
7,467,651 B2 * 12/2008 Karkosch et al. ..... 144/136.95
7,621,206 B2 * 11/2009 Makropoulos ..... 83/574

* cited by examiner

*Primary Examiner* — Shelley Self
(74) *Attorney, Agent, or Firm* — Lambert & Associates; Gary E. Lambert; David J. Connaughton, Jr.

(57) ABSTRACT

A nimble and free moving guide and support apparatus for hand-held cutting devices. The device utilizes vertical support members to maintain contact with a work surface, while a base plate maintains contact with the material to be cut. Above said base plate is mounted a cutting device, such as a router, where the cutting members of said cutting device pass through an opening in said base plate. The nimbleness and free movement of this apparatus are provided by a movement mechanism, such as a ball bearing housed at the end of the vertical support members.

15 Claims, 7 Drawing Sheets

MOBILE HAND-HELD CUTTING DEVICE GUIDE AND SUPPORT APPARATUS

FIELD OF THE INVENTION

The present invention relates generally to cutting device guide and support structures and more specifically to a new and improved mobile router guide and support apparatus wherein said apparatus comprises a support plate upon which the cutting end of a router will be mounted.

REFERENCES

In general within the art, descriptions of hand-held cutting guide-and-support devices in U.S. Pat. Nos. 4,290,719 set forth by Worthington; and 4,434,824 by Bussey; and 5,062,460 by Deline; and 6,792,984 by Fontaine; and Re. 33,045 by Gronholz; and U.S. Pat. Nos. 7,089,978 by Karkosch; and 6,880,595 by Nuss; and 5,092,234 by; and 7,281,887 by Taylor.

BACKGROUND OF INVENTION

Various portable tools have been designed to quickly make accurate and particularly designed cuts in various types of materials. Routers for instance can be used to make cuts into wood to create various designs for any type of wood product. Hand-held routers in particular have the advantages of portability and allow free movement over a cutting surface. However, they have some distinct disadvantages as well.

Hand-held routers, despite their advantages, can be difficult to use at times. Being hand held allows them great flexibility of movement, however, it comes at the price of stability and accuracy. Since these routers are hand-held, they are only as stable as the person holding them. This invariably leads to lost material and time when an errant slip, often even a slight one, can ruin a piece of wood being fabricated for a specific look or design. This has led to the development of various attempts to provide a support means for a number of hand-held cutting tools, including routers.

Previous attempts at support apparatuses for cutting tools such as routers involved using a plate with a handle mounted to it and an opening around which the cutting device would be mounted so that the device's cutting members could contact the surface of the material to be cut as required.

Another attempt mounted the cutting device in a tray that had an opened bottom through which the cutting members made contact with the cutting members made contact with the surface of the material to be cut. In addition this design mounts the tray to two rods that pass through two sets of openings at each end of the tray. These rods in turn are mounted where their two ends pass through an opening in a vertical support piece (so four vertical support pieces in all, two per rod). Each of these vertical support pieces then lie on opposite ends of two horizontal support bars. This allows the tray itself to move in a left-right fashion, while the cutting device within the tray itself may move in a line perpendicular to the movement allowed by the tray along the rods.

Another attempt involved mounting a cutting device to a circular end with an opening through which the cutting members would pass so as to make contact with the cutting surface of the material. In this design the circular end can move up and down along a slide to which the circular end is attached.

Another attempt used a mounting surface with an opening around which the cutting device was mounted and through which the cutting members of the cutting device would pass in order to contact the surface of the material to be cut. This design made use of two bottom-mounted wheels to provide movement along a cutting surface and sliding carriage to move the cutting device for movement away from the cutting surface.

Previous attempts at providing support for hand-held cutting devices fall short of providing all the benefits that the present invention offers. Nothing found in the prior art provides a stable and mobile mounting apparatus that maintains the nimbleness of a free hand-held cutting device that the present invention provides. Some of these prior attempts may allow for vertical and horizontal surface movement, but not in both simultaneously. Those that do allow vertical and horizontal surface movement often do so awkwardly and also lack a convenient method to make adjustments in another dimension (height adjustments). Some of these attempts also involve cumbersome designs with many moving pieces that must be adjusted frequently, which lowers productivity.

What is needed is a mobile but nibble cutting device guide and support apparatus that is easily adjustable for movement in all three dimensions. This invention provides that functionality.

SUMMARY OF THE INVENTION

The instant invention, as illustrated herein, is clearly not anticipated, rendered obvious, or even present in any of the prior art mechanisms, either alone or in any combination thereof. A mobile hand-held cutting device guide and support apparatus designed to overcome the previously mentioned shortcomings would give users a much more effective means of cutting specific shapes or designs into a select piece of material to be cut. Thus, the several embodiments of the instant invention are illustrated herein.

Therefore, it is an object of the present invention to overcome the previously mentioned shortcomings found in prior art cutting device guide and support systems by providing a mobile hand-held cutting device support apparatus that will move easily and freely along a surface in both the horizontal and vertical directions.

Another object of the present invention is to provide a mobile hand-held cutting device guide and support apparatus that is also easily adjusted in a plane perpendicular to the cutting surface (height adjustment).

Another object of the present invention is to provide a mobile hand-held cutting device guide and support apparatus that provides a measurement means to adjust movement in the plane perpendicular to the cutting surface.

Another object of the present invention is to provide a mobile hand-held cutting device guide and support apparatus with a means for securing various types of cutting devices to itself.

Another object of the present invention is to provide a mobile hand-held cutting device guide and support apparatus that moves along a cutting surface while maintaining contact with the material that is being cut.

Another object of the present invention is to provide a mobile hand-held cutting device guide and support apparatus that may be durable.

Another object of the present invention is to provide a mobile hand-held cutting device guide and support apparatus that may be light weight.

Another object of the present invention is to provide a mobile hand-held cutting device guide and support apparatus whose component parts may be comprised of a variety of metals, metal alloys, metal alloy composites, composites and polymers as well as other materials.

Another object of the present invention is to provide a mobile hand-held cutting device guide and support apparatus that provides a means for securely fastening the cutting device to the apparatuses support plate.

These together with other objects of the invention, along with various features of novelty which characterize the invention, are pointed out with particularity in the claims and Detailed Description of the Embodiments Sections, and drawings of this application, with all said sections also adding to this disclosure.

DETAILED DESCRIPTION OF THE DISCLOSED EMBODIMENTS

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as mobile cutting guides of different shapes, dimensions and different components.

Presently, there are no mobile cutting guides for hand-held cutting tools that are durable and as nimble, as put forth by the present invention. Some previous apparatuses allow for a means to support a cutting device, but fail to provide a means to freely and easily move about a cutting surface.

The present invention solves all these shortcomings by introducing a mobile guide for hand-held cutting tools, which allows a user to freely and easily move the guide along a cutting surface. Further, the use of various disk members allows for this cutting guide to be used with various hand-held cutting devices. This allows users to have an effective way of providing stability while making cuts in a given material, but maintain the advantages gained by having a portable hand-held cutting device. In addition, the ability to modify the height of the vertical support member allows the user to maintain contact with the work surface (to maintain stability) while being able to keep the cutting members of the cutting device in contact with various cutting materials of various dimensions.

Figure 1:
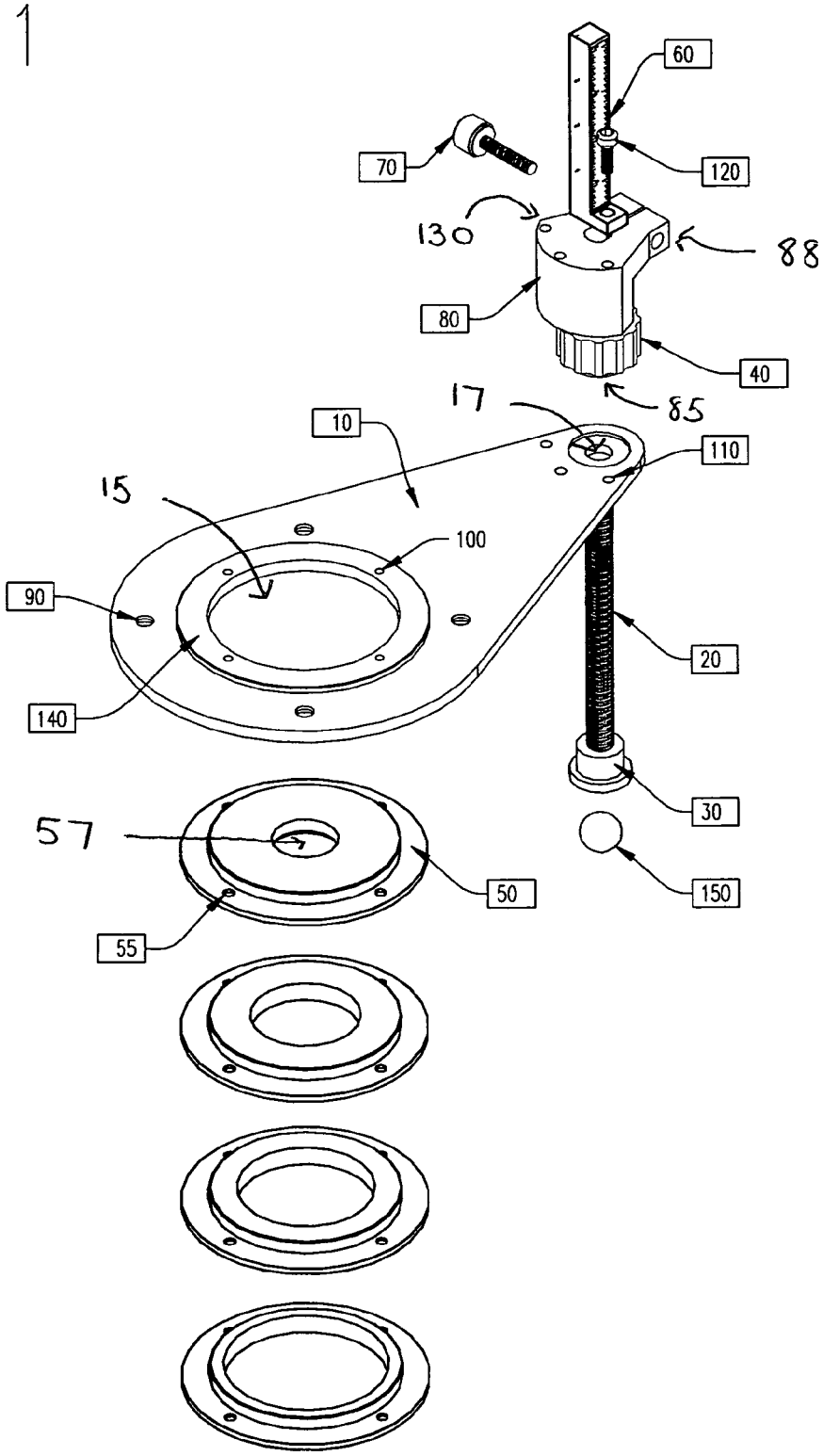
FIG. 1 illustrates an exploded view of one embodiment of the mobile cutting guide apparatus. Visible here are a base-plate, a vertical support member, a vertical support member attachment means, a height-adjustment member, a mobility means (ball bearing), a measurement apparatus, and four representative disk members to which various cutting devices may be attached.
Figure 2:
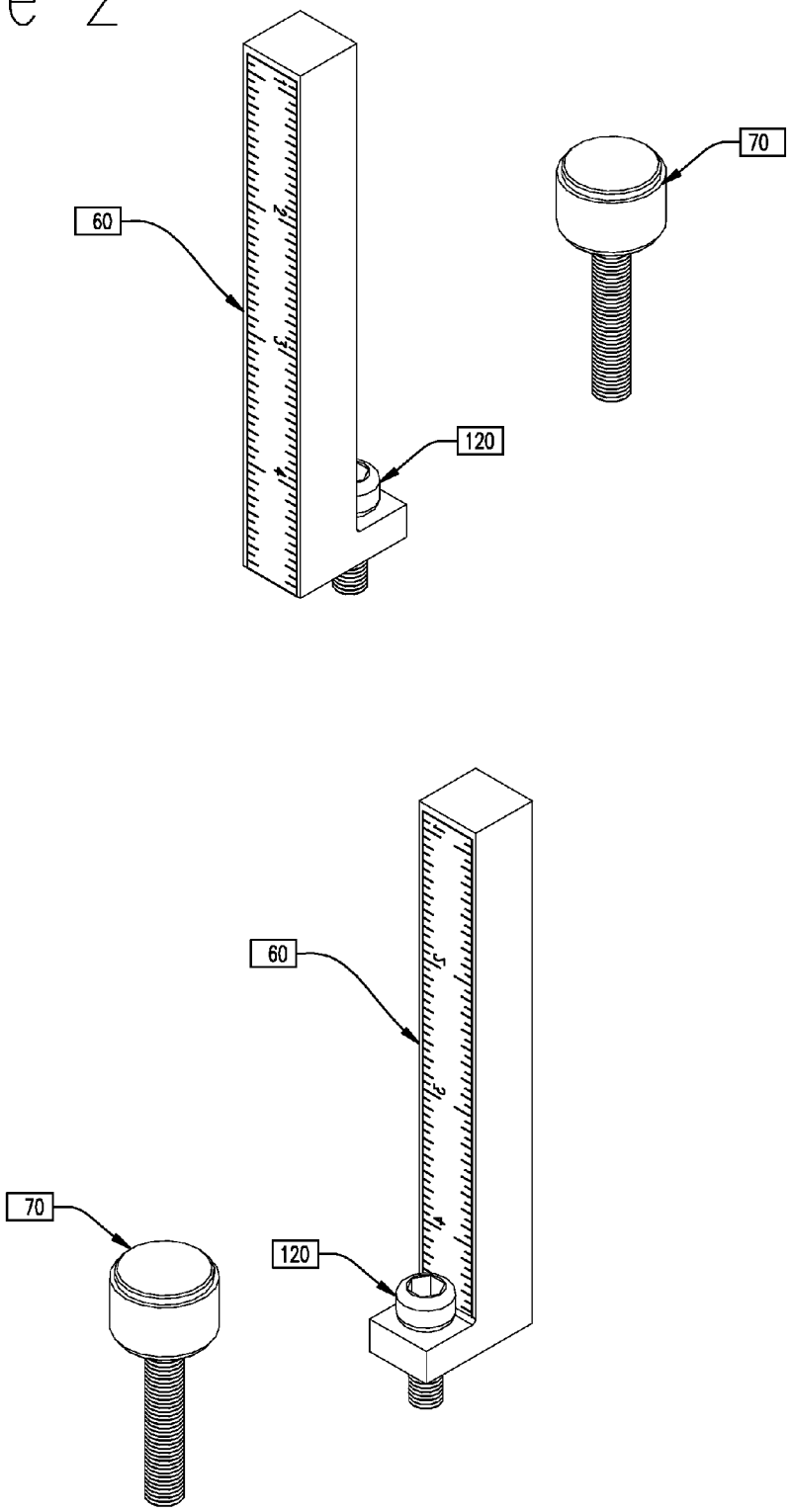
FIG. 2 illustrates an angled front and an angled rear view of the measurement means apparatus as seen in FIG. 1. Also displayed in FIG. 2 is a view of a measurement apparatus attachment means and a securing member for the vertical member attachment means.
Figure 3:
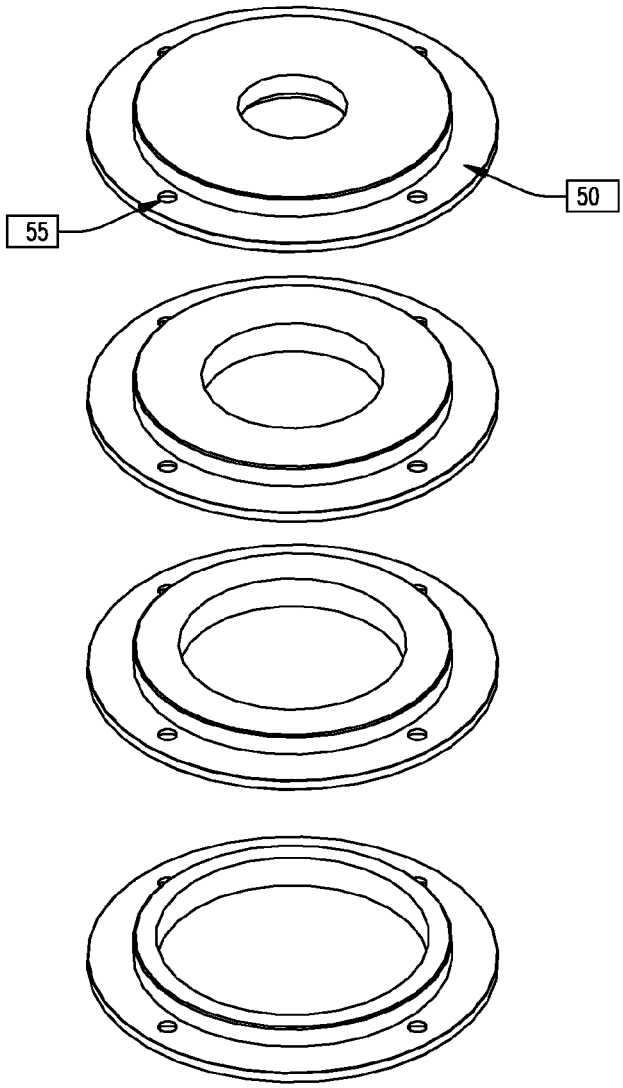
FIG. 3 illustrates a four disk members, each with four open cavities through which a disk member attachment means may pass.
Figure 4:
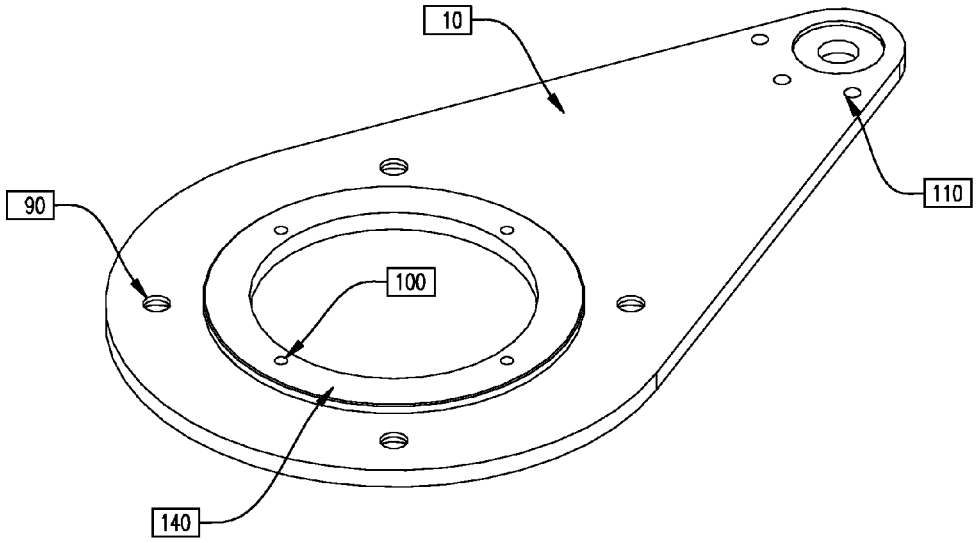
FIG. 4 illustrates a top and bottom view of the base-plate. Visible is a ring comprising four open cavities through which attachment members may pass, a vertical-support-member opening through which a vertical-support member may pass, three open cavities about said vertical-support-member opening through which vertical-support-member-to-base-plate attachment members may pass and four open cavities through which base-plate-to-cutting-device attachment means may pass.
Figure 4:
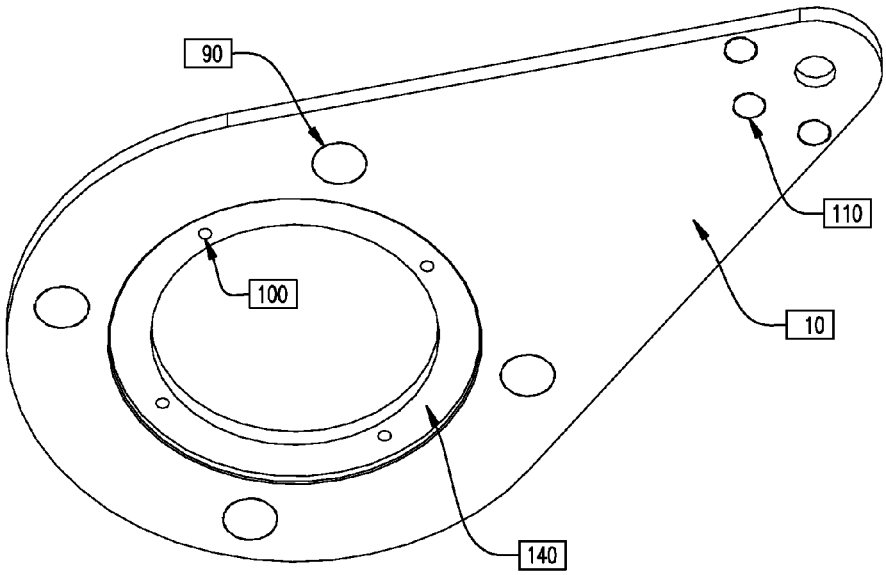
Figure 5:
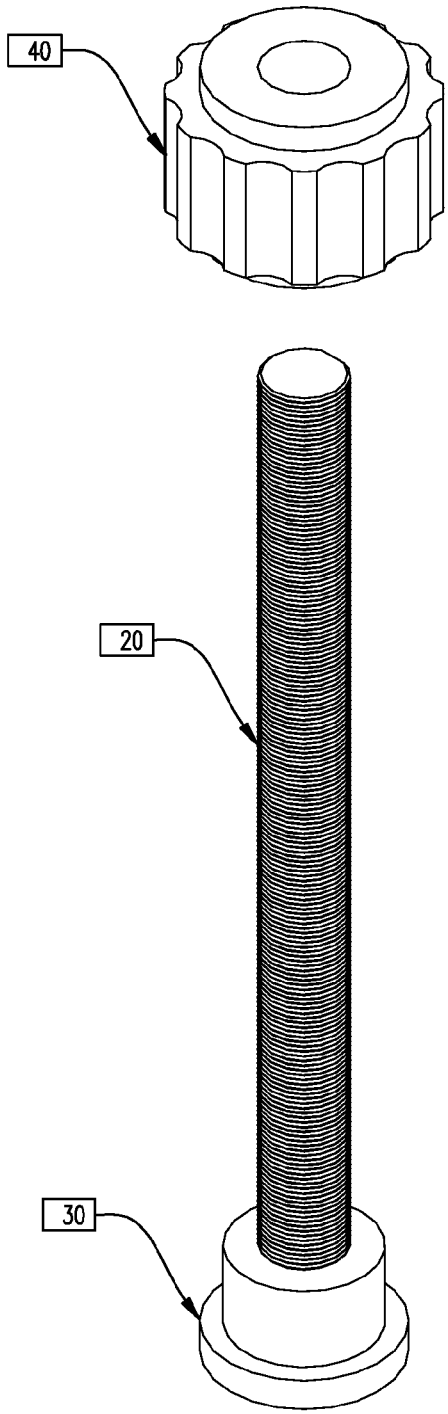
FIG. 5 illustrates a helically-threaded vertical-support member, a movement-means housing attached to said vertical support member and a vertical-height adjustment member.
Figure 6:
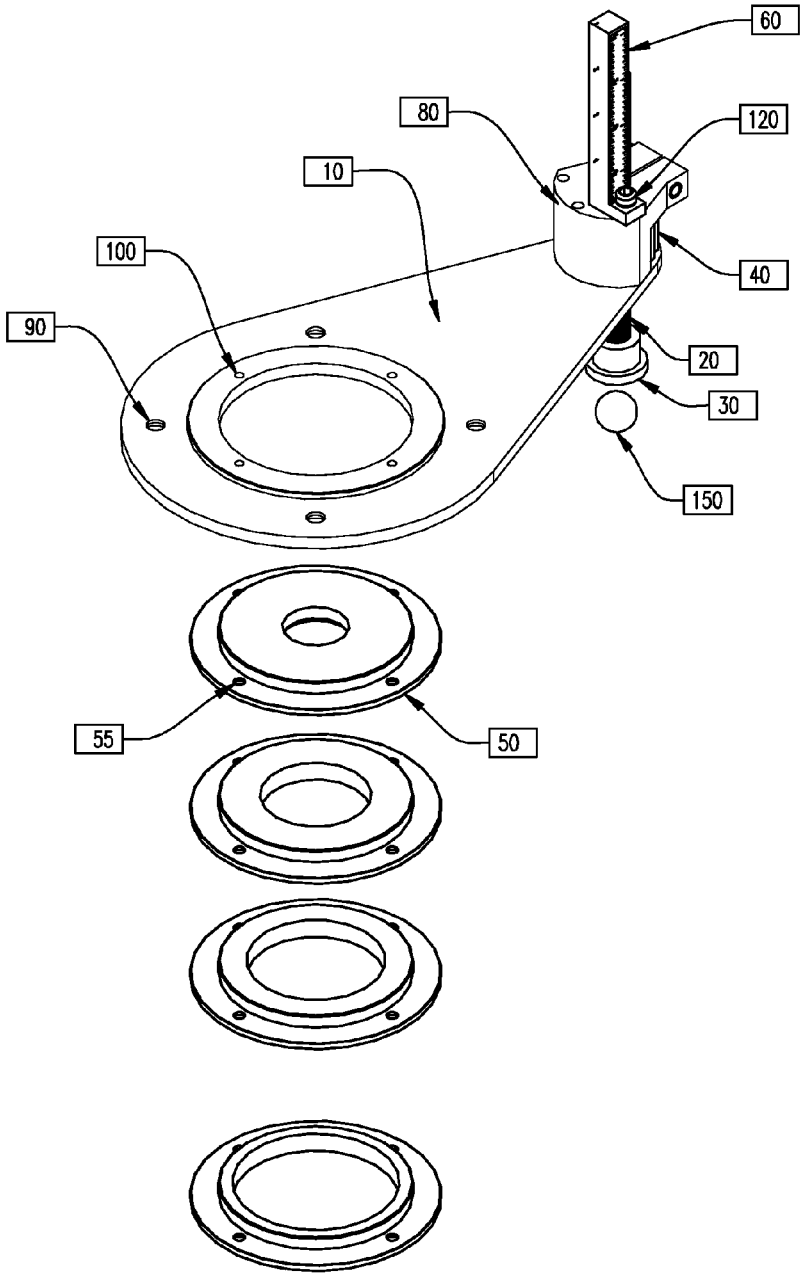
FIG. 6 illustrates an assembled mobile cutting guide apparatus, wherein a base plate member, a base-plate-to-disk-member ring, a vertical support member, a vertical support member attachment means, a vertical-height adjustment means, a mobility-means housing, a mobility means, a measurement means, a measurement means attachment member, four disk members, sixteen (four on each disk member depicted) disk-member-to-base-plate-ring attachment-member open cavities, four base-plate-ring-to-disk-member attachment member open cavities, four base-plate-to-cutting-device attachment-member open cavities, two vertical-support-member-attachment-member-to-measuring-member attachment member open cavities and one vertical-support-member-tightening means open cavity.
Figure 7:
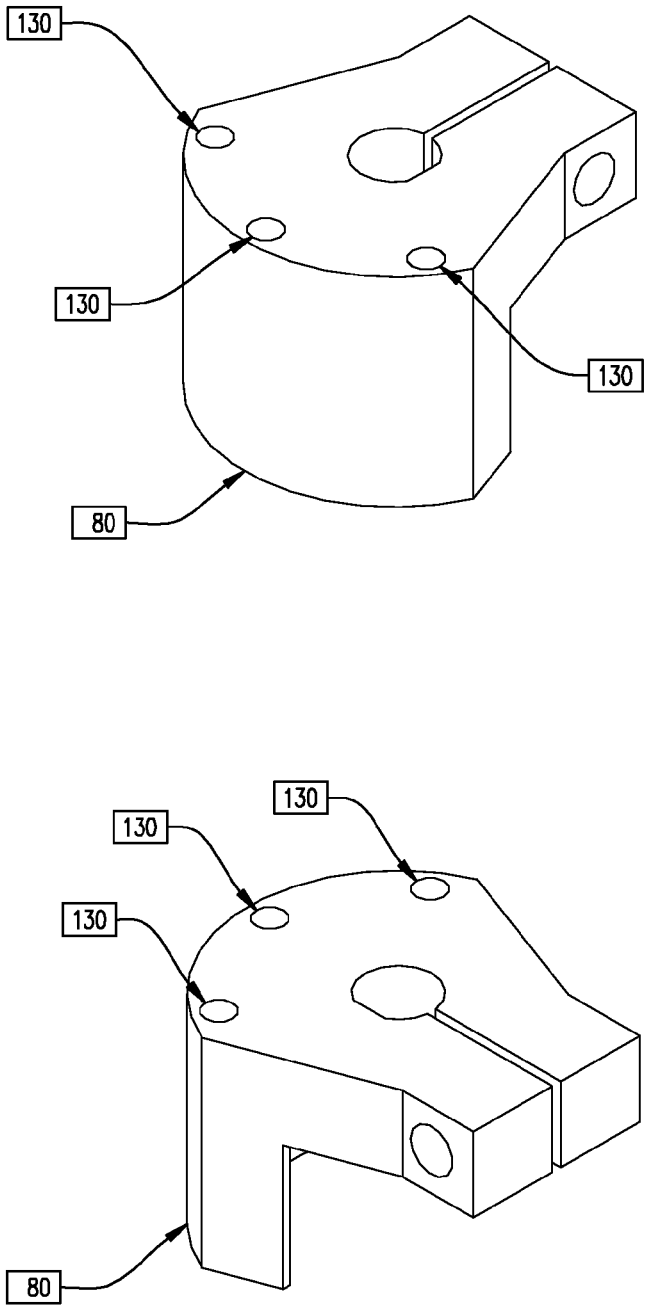
FIG. 7 illustrates an angled front and rear view of the vertical-support-member attachment means. Visible are three vertical-support-member-to-measuring-member attachment member open cavities, and one vertical-support-member-tightening means open cavity.

FIG. 1 shows an exploded view of the mobile cutting guide, wherein many of the components for this embodiment are displayed. The base plate 10, comprises a ring 140, an opening 15, a vertical-support-member opening 17, a plurality of attachment cavities 90 about said ring 140 and a plurality of attachment cavities 110 about said vertical-support-member opening 17. Further said ring 140 further comprising a plurality of attachment openings 100 located within said ring 140.

Also depicted in FIG. 1, is a vertical-support member 20 comprising a helically threaded surface, and a mobility housing 30 attached to said vertical-support member by an attachment.

Further, depicted in FIG. 1 is the height-adjustment member 40 comprising a grooved outer surface for easy gripping and a helically threaded inner surface through which said vertical-support member 20 may pass. Attached to said base-plate 10 and over said height adjustment member 40 is the attachment 80 comprising a plurality of cavities 130, one tightening-member cavity 88 and one vertical-support-member opening 85 through which the 20 may pass. Said attachment member 80 being placed over said height adjustment member 40, so that as the height adjustment member 40 is rotated left or right said vertical-support member's 20 height will raised or lowered relative to the distance between said the mobility housing 30 and where the vertical-support member contacts the bottom of said base plate 10.

Further depicted in FIG. 1 is a measurement member 60, removably attached to said attachment member 80 by a attachment 120 that passes through one of the plurality of cavities 130. Measurements being made by said measurement member 60 by comparing the height of said vertical-support member 20 found above said attachment member 80 to the given units of measure on said measurement member 60.

Further depicted in FIG. 1 is the tightening member 70 which may pass through said tightening-member cavity 88 so as to securely hold said vertical-support-member 20.

Further depicted in FIG. 1 is the mobility means 150, here shown as a ball bearing, held within said mobility housing 30 by a holding means.

Further depicted in FIG. 1 is a plurality of disk members 50, comprising a plurality of attachment cavities 55 and one central opening 57. Said disk members 50 being removably attached to said base-plate ring 140 by an attachment passing through said attachment cavities 55 and 100.

In other embodiments of this invention the dimensions, shapes and construction materials of the mobile cutting device apparatus may vary. In these other embodiments the shapes and dimensions of said cutting guide may also vary, including but not limited to, the dimensions of all openings and cavities comprised within said base plate member 10. In addition, the dimensions and the units of measure associated with said measurement member 60 may vary. Further the dimensions of the disk members 50 may vary including the dimensions of said central opening 57. Further, the type of mobility means used may also vary in other embodiments, including but not limited to, removably attached tread members attached to said vertical support member or removably attached to said mobility housing member.

What is claimed is:

1. A guide and support apparatus for a cutting device comprising:

a base plate comprising a ring and a vertical support member opening;

a vertical support member, wherein the vertical support member is received through the base plate vertical support member opening;

a mobility housing attached to the vertical support member, and a ball bearing positioned within the mobility housing;

an attachment member forming a plurality of cavities, one of the plurality of cavities receiving the vertical support member;

a height adjustment member, wherein the height adjustment member has an opening which receives the vertical support member; and wherein the attachment member comprises:

a measurement member; and an attachment, wherein the attachment is disposed to allow removable attachment of the measurement member to the attachment member when passed through one of the plurality of cavities formed by the attachment member.

2. The apparatus of claim 1, wherein the apparatus is disposed to allow measurement and movement in three dimensions, both a horizontal and vertical direction along a cutting surface and in a third dimension that is perpendicular to the cutting surface.

3. The apparatus of claim 2, wherein the vertical support member is constructed to enable the base plate to maintain contact with a cutting surface.

4. The apparatus of claim 1, wherein the base plate further comprises a plurality of attachment cavities disposed around the ring of the base plate.

5. The apparatus of claim 1, wherein the base plate further comprises a plurality of attachment cavities disposed around the vertical support member opening of the base plate.

6. The apparatus of claim 4, wherein the ring of the base plate forms a plurality of attachment openings.

7. The apparatus of claim 1, wherein the vertical support member possesses a helically threaded outer surface.

8. The apparatus of claim 1, wherein the attachment member further comprises:

a tightening member cavity; and a tightening member, wherein the tightening member is disposed to be received in the tightening member cavity.

9. The apparatus of claim 8, wherein the tightening member is disposed to securely hold the vertical support member in place when the vertical support member is received through the vertical support member opening of the base plate.

10. The apparatus of claim 4 further comprising a plurality of disk members, wherein the disk members are removably attached to the base plate ring.

11. The apparatus of claim 10, wherein each individual disk member further comprises:

a central opening; and a plurality of attachment cavities, the disk member capable of removable attachment to the base plate ring by a second attachment passing through one of the plurality of attachment cavities of the disk member, and one of the plurality of the attachment cavities of the base plate ring.

12. The apparatus of claim 1, wherein the height adjustment member receives the vertical support member by rotatable attachment and wherein the height adjustment member is disposed to control a height of the vertical support member in relation to the mobility housing by rotation of the height adjustment member.

13. The apparatus of claim 1, wherein a measurement of a position of the base plate relative to the mobility housing is obtained by comparing a height of the vertical support member which is located above the attachment member to a height of a plurality of units marked on the measurement member.

14. The apparatus of claim 1, further comprising a router, the apparatus constructed and arranged to enable the router to move in vertical direction by rotation of the height adjustment member to accommodate the level of a material to be cut by the router.

15. A guide and support apparatus for a cutting device, wherein the apparatus is disposed to allow measurement and movement in three dimensions, both a horizontal and vertical direction along a cutting surface and in a third dimension that is perpendicular to the cutting surface, the apparatus comprising:

a base plate, wherein the base plate further comprises:

a ring;

a vertical support member opening;

a plurality of attachment cavities disposed around the base plate ring;

a plurality of attachment cavities disposed around the vertical support member opening;

a plurality of attachment openings formed by the ring;

a vertical support member, wherein the vertical support member is received through the vertical support member opening of the base plate, the vertical support member further comprising:

a mobility housing, wherein the mobility housing is attached to the vertical support member; and a ball bearing, wherein the ball bearing is located within the mobility housing and disposed to allow the apparatus to slide on a cutting surface in any direction;

an attachment member forming a plurality of cavities the vertical support member received by one of the plurality of cavities;

a height adjustment member, wherein the height adjustment member has an opening which receives the vertical support member; and wherein the attachment member further comprises:

a measurement member; and an attachment, wherein the attachment is disposed to allow removable attachment of the measurement member to the attachment member when passed through one of the plurality of cavities of the attachment member;

a tightening member cavity; and a tightening member, wherein the tightening member is disposed to be received in the tightening member cavity to securely hold the vertical support member;

a plurality of disk members, wherein the disk members are disposed to be removably attached to the base plate ring, wherein each of the plurality of disk members further comprises:

a central opening; and a plurality of attachment cavities disposed around each disk member and capable of removable attachment to the base plate ring by a second attachment passing through one of said plurality of attachment cavities of the disk member and one of the plurality of attachment cavities formed by the base plate ring.

* * * * *